US011554843B2

(12) United States Patent
Inoue

(10) Patent No.: US 11,554,843 B2
(45) Date of Patent: Jan. 17, 2023

(54) COURSE CONTROL SYSTEM FOR MARINE VESSEL, AND MARINE VESSEL

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 65 days.

(21) Appl. No.: 17/144,284

(22) Filed: Jan. 8, 2021

(65) Prior Publication Data

US 2021/0229791 A1 Jul. 29, 2021

(30) Foreign Application Priority Data

Jan. 29, 2020 (JP) ..... JP2020-012216

(51) Int. Cl.

| | |
|---|---|
| ***B63H 25/38*** | (2006.01) |
| ***B63H 19/02*** | (2006.01) |
| ***B63H 19/08*** | (2006.01) |
| ***B63H 25/14*** | (2006.01) |

(52) U.S. Cl.

CPC ..... *B63H 25/38* (2013.01); *B63H 19/02* (2013.01); *B63H 19/08* (2013.01); *B63H 25/14* (2013.01)

(58) Field of Classification Search

CPC ..... B63H 25/00; B63H 25/08; B63H 25/14; B63H 25/30; B63H 25/38; B63H 19/00; B63H 19/02; B63H 19/08; G05D 1/02

USPC ..... 114/162

See application file for complete search history.

(56) References Cited

U.S. PATENT DOCUMENTS

| | | | | |
|---|---|---|---|---|
| 8,631,753 | B2 * | 1/2014 | Morvillo | B63H 25/44 114/285 |
| 10,338,593 | B2 * | 7/2019 | Johnson | B63H 25/08 |

FOREIGN PATENT DOCUMENTS

JP 2009286297 A 12/2009

OTHER PUBLICATIONS

International Maritime Organization, "Revised Guidance To the Master for Avoiding Dangerous Situations in Adverse Weather and Sea Conditions", Issued on Jan. 11.2007.

* cited by examiner

*Primary Examiner* — Lars A Olson
(74) *Attorney, Agent, or Firm* — Rabin & Berdo, P.C.

(57) ABSTRACT

A marine vessel having a propeller that provides propulsive force to the marine vessel, and a course control system. The course control system includes a course changing mechanism that changes a course of the marine vessel, and a controller configured or programmed to detect a sudden movement of the marine vessel originating from broaching caused by a following wave of the marine vessel, and upon detecting the sudden movement of the marine vessel originating from the broaching, control a rotation rate of the propeller and/or cause the course changing mechanism to change the course of the marine vessel.

19 Claims, 10 Drawing Sheets

COURSE CONTROL SYSTEM FOR MARINE VESSEL, AND MARINE VESSEL

CROSS REFERENCE TO RELATED APPLICATIONS

This application claims the benefit of priority to Japanese Patent Application No. 2020-012216, filed on Jan. 29, 2020. The entire contents of this application are hereby incorporated herein by reference.

BACKGROUND OF THE INVENTION

1. Field of the Invention

The present invention relates to course control systems for marine vessels equipped with a marine propulsion device like an outboard motor, and also relates to the marine vessels.

2. Description of the Related Art

When a marine vessel encounters a following wave that follows the marine vessel from diagonally behind while sailing, a broaching-to phenomenon or surf-riding phenomenon (also referred to simply as broaching or surf-riding) may occur, causing the marine vessel to lose rudder control and make a sudden movement of turning its head so as to make the longitudinal direction of the marine vessel parallel to the following wave. For such a marine vessel to recover from a state showing a sudden movement to a state showing no sudden movement (normal state), it is necessary to, for example, turn the rudder of the marine vessel in a direction opposite to a direction in which the marine vessel is turning its head, but it is difficult even for an experienced vessel operator to properly adjust the timing and amount of rudder control, and as a result, it is difficult for the marine vessel to recover from a sudden movement originating from broaching to a normal state by the vessel operator.

It is thus preferred that steering for recovering from a sudden movement of a marine vessel caused by a wave such as broaching is automated. As a technique of controlling the behavior of a marine vessel, a control apparatus that uses an output from an acceleration sensor provided in the marine vessel, to automatically control an engine rpm (revolutions per minute) so as to change the behavior of the marine vessel is known (see, for example, Japanese Laid-open Patent Publication (Kokai) No. 2009-286297).

Japanese Laid-open Patent Publication (Kokai) No. 2009-286297, however, does not mention that the rudder of the marine vessel is automatically controlled for the purpose of causing the marine vessel to recover from a sudden movement of the marine vessel caused by a wave. For this reason, there is still room for improvement in making it easier for the marine vessel to recover from a sudden movement originating from broaching.

SUMMARY OF THE INVENTION

The present invention provides course control systems for marine vessels, and marine vessels, which make it easy for marine vessels to recover from a sudden movement originating from broaching without relying on vessel operators.

According to an embodiment of the present invention, a course control system for a marine vessel includes a course changing mechanism that changes a course of the marine vessel, and a controller. The marine vessel has a propeller that provides propulsive force to the marine vessel. The controller is configured or programmed to detect a sudden movement of the marine vessel originating from broaching caused by a following wave of the marine vessel. The controller is further configured or programmed to, upon detecting the sudden movement of the marine vessel originating from the broaching, control a rotation rate of the propeller and/or cause the course changing mechanism to change the course of the marine vessel.

According to another embodiment of the present invention, a course control system for a marine vessel includes a controller configured or programmed to detect whether or not broaching has occurred or preconditions of occurrence of the broaching are satisfied based on a length between perpendiculars of a hull of the marine vessel, and a wavelength, a wave height, and a traveling direction of a following wave.

According to an embodiment of the present invention, in the course control system for a marine vessel, when a sudden movement of the marine vessel originating from broaching is detected, the controller causes the course changing mechanism to control the course of the marine vessel and/or controls the rotation rate of the propeller. As a result, it restores rudder control so that a vessel operator can control the course of the marine vessel through the rudder. Accordingly, the hull of the marine vessel is automatically prevented from becoming parallel to a following wave, and the marine vessel easily recovers from the sudden movement originating from broaching without relying on a vessel operator.

The above and other elements, features, steps, characteristics and advantages of the present invention will become more apparent from the following detailed description of the embodiment with reference to the attached drawings.

DETAILED DESCRIPTION OF THE PREFERRED EMBODIMENTS

Hereinafter, the embodiments will be described with reference to the drawings.

Figure 1A:
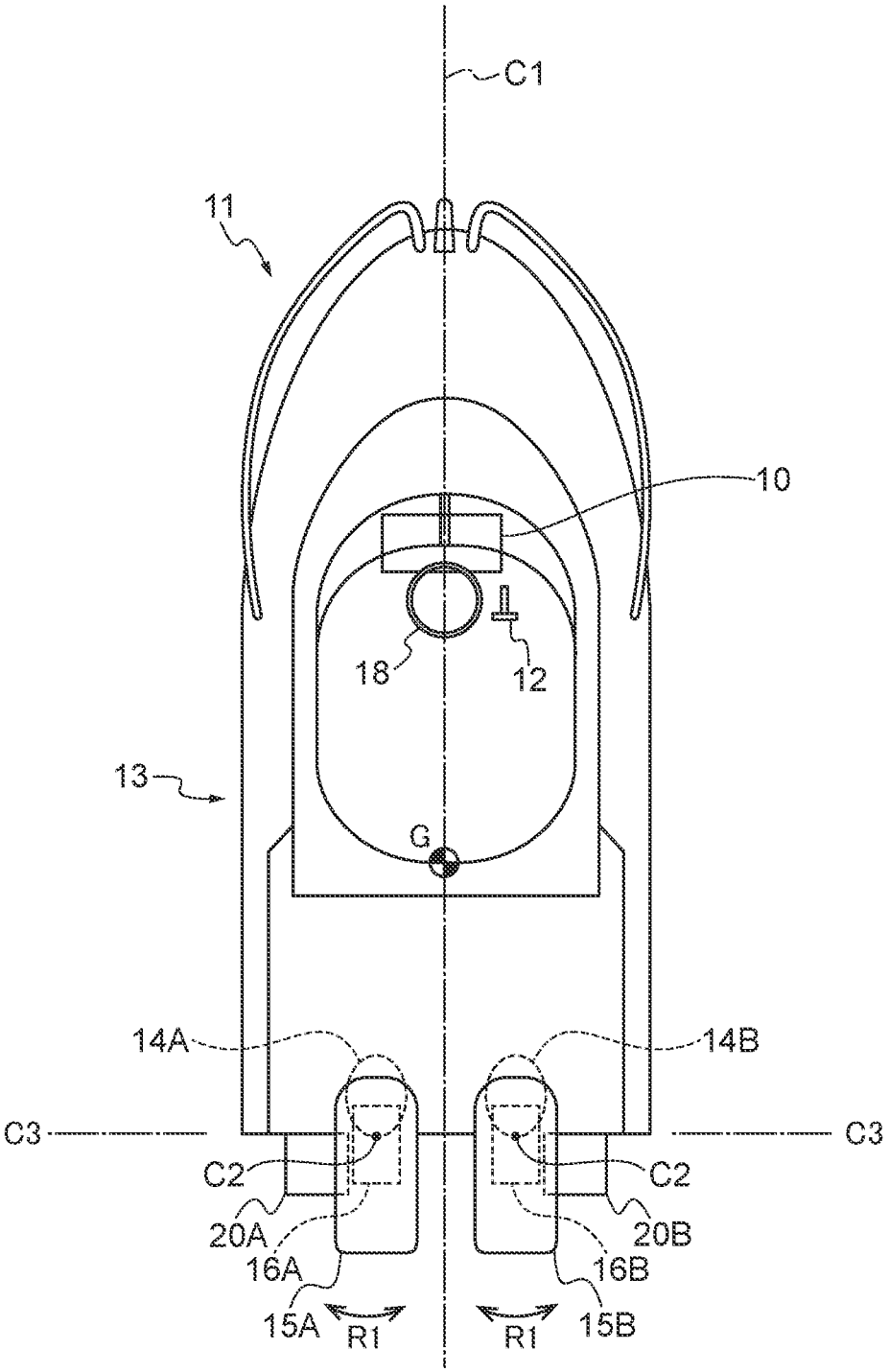
FIG. 1A and FIG. 1B are a top view and a side view of a marine vessel to which a course control system for the marine vessel according to an embodiment of the present invention is provided.
Figure 1B:
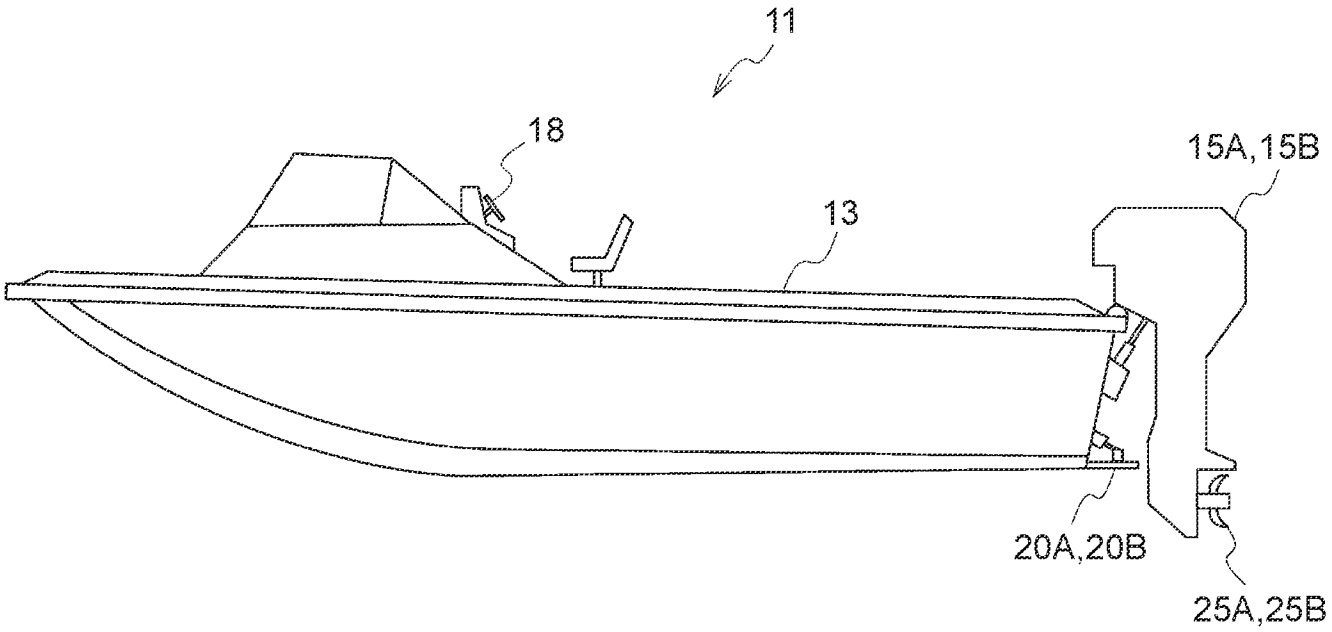

FIG. 1A and FIG. 1B are a top view and a side view of a marine vessel to which a course control system for the marine vessel according to an embodiment of the present invention is provided. The marine vessel 11 is a planning boat and includes a hull 13, a plurality of outboard motors (for example, two outboard motors 15A, 15B illustrated in FIGS. 1A and 1B) which define and function as marine propulsion devices mounted on the hull 13, and a plurality of trim tab units (for example, a pair of trim tab units 20A, 20B illustrated in FIGS. 1A and 1B). A central unit 10, a steering wheel 18, and a throttle lever 12 are provided in the vicinity of a cockpit in the hull 13.

In the following description, a fore-and-aft direction, a crosswise direction, and a vertical direction refer to a fore-and-aft direction, a crosswise direction, and a vertical direction, respectively, of the hull 13. For example, as shown in FIG. 1A, a centerline C1 extending in the fore-and-aft direction of the hull 13 passes through the center of gravity G of the marine vessel 11. The fore-and-aft direction is the direction along the centerline C1. Fore or front refers to the direction toward the upper side of the view along the centerline C1. Aft or rear refers to the direction toward the lower side of the view along the centerline C1. The crosswise direction is defined based on a case in which the hull 13 is viewed from the rear. The vertical direction is vertical to the fore-and-aft direction and the crosswise direction.

The two outboard motors 15A and 15B are attached to a stern of the hull 13 side by side. To distinguish the two outboard motors 15A and 15B, the one located on the port side is referred to as the "outboard motor 15A", and the one located on the starboard side is referred to as the "outboard motor 15B". The outboard motors 15A and 15B are mounted on the hull 13 via mounting units 14A an 14B, respectively. The outboard motors 15A and 15B include respective engines 16A and 16B, which are, e.g., internal combustion engines. The outboard motors 15A and 15B include respective propellers 25A and 25B that are turned by driving forces of the corresponding engines 16A and 16B and provide propulsive forces to the marine vessel 11.

Figure 3:
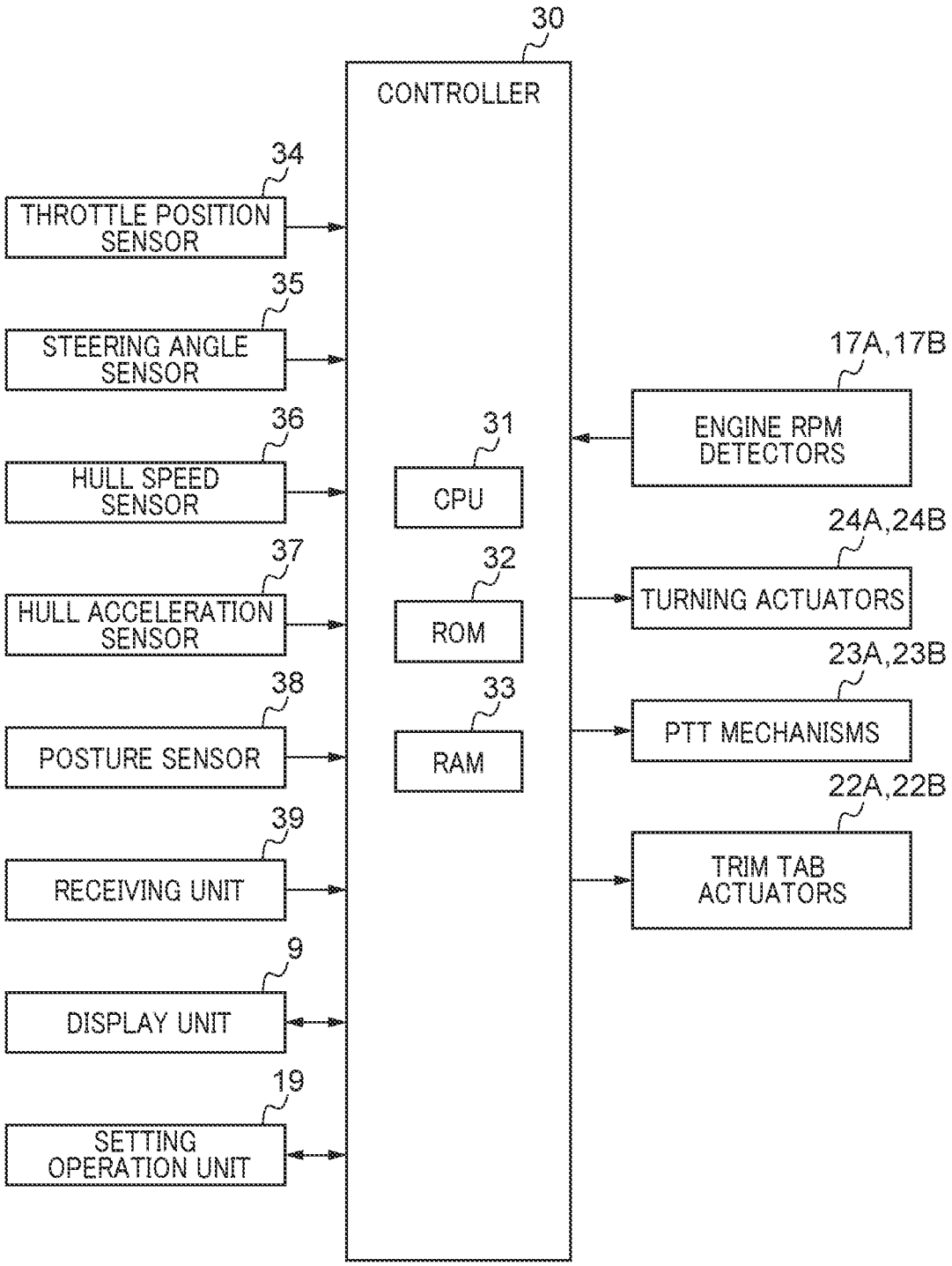
FIG. 3 is a block diagram of a maneuvering system.

The mounting units 14A and 14B each includes a swivel bracket, a clamp bracket, a steering shaft, and a tilt shaft (none of which are illustrated). The mounting units 14A and 14B further include power trim and tilt mechanisms (PTT mechanisms) 23A and 23B, respectively (FIG. 3). The PTT mechanisms 23A and 23B turn the corresponding outboard motors 15A and 15B about the tilt shaft. This makes it possible to change an inclination angle of the outboard motors 15A and 15B with respect to the hull 13, and thus a trim adjustment is carried out, and the outboard motors 15A and 15B are tilted up and down. Moreover, the outboard motors 15A and 15B are able to turn about a turning center C2 (about the steering shaft) with respect to the swivel bracket. Operating the steering wheel 18 causes the outboard motors 15A and 15B to turn about the turning center C2 in the crosswise direction (direction R1).

The pair of trim tab units 20A and 20B are attached to the stern on the port side and the starboard side such that they are able to swing about a swing axis C3. To distinguish the two trim tab units 20A and 20B from each other, the one located on the port side is referred to as the "trim tab unit 20A", and the one located on the starboard side is referred to as the "trim tab unit 20B".

Figure 2:
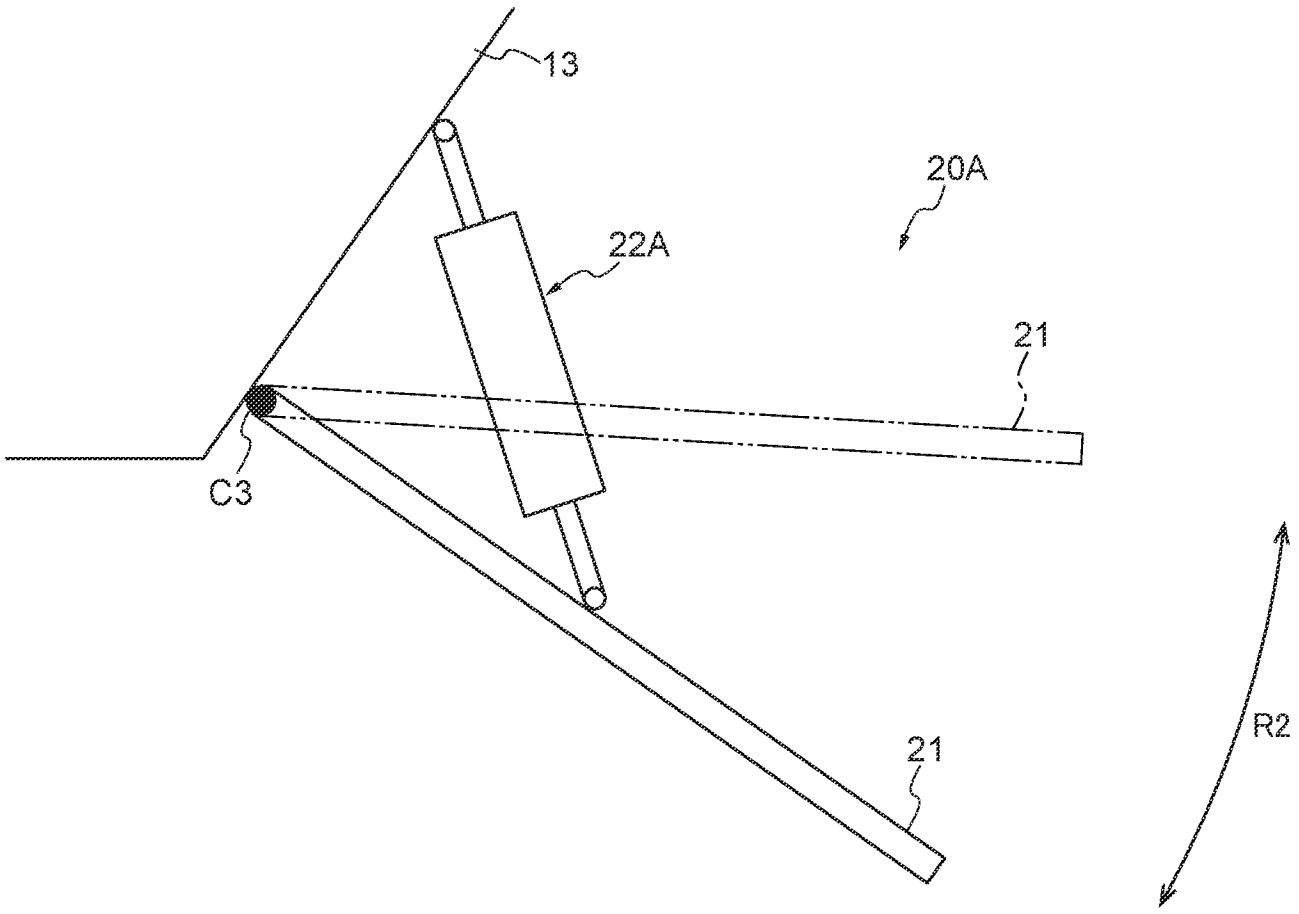
FIG. 2 is a side view of a trim tab unit attached to a hull.

FIG. 2 is a side view of the trim tab unit 20A attached to the hull 13. The trim tab units 20A and 20B have the same construction, and thus a construction of only the trim tab unit 20A will now be described as a representative example. The trim tab unit 20A includes a trim tab actuator 22A and a tab 21. The tab 21 is attached to the rear of the hull 13 such that it is able to swing about the swing axis C3. For example, the proximal end of the tab 21 is attached to the rear of the hull 13, and the free end of the tab 21 swings up and down (in a swinging direction R2) about the swing axis C3. The tab 21 is an example of a posture control tab that controls the posture of the hull 13.

The trim tab actuator 22A is disposed between the tab 21 and the hull 13 such that it connects the tab 21 and the hull 13 together. The trim tab actuator 22A actuates the tab 21 to swing it with respect to the hull 13. The tab 21 is capable of swinging down to a level lower than a swing position indicated by a solid line. It should be noted that the tab 21 indicated by a chain double-dashed line in FIG. 2 is at a position where its free end is at the highest level (a position at which the amount of lowering of the tab 21 is 0%), and this position corresponds to a retracted position. The tab 21 indicated by a solid line in FIG. 2 is at a position where its free end is at a lower level than a keel at the bottom of the marine vessel 11. The swinging direction R2 is defined with reference to the swing axis C3. The swing axis C3 is perpendicular or substantially perpendicular to the centerline C1 and parallel or substantially parallel to, for example, the crosswise direction. It should be noted that the swing axis C3 may extend diagonally so as to cross the turning center C2.

FIG. 3 is a block diagram of a maneuvering system. The maneuvering system includes a course control system for a marine vessel according to the present embodiment. The marine vessel 11 includes a controller 30, a throttle position sensor 34, a steering angle sensor 35, a hull speed sensor 36, a hull acceleration sensor 37, a posture sensor 38, a receiving unit 39, a display unit 9, and a setting operation unit 19. The marine vessel 11 also includes engine rpm detectors 17A and 17B, turning actuators 24A and 24B, the PTT mechanisms 23A and 23B, and the trim tab actuators 22A and 22B.

The controller 30, the throttle position sensor 34, the steering angle sensor 35, the hull speed sensor 36, the hull acceleration sensor 37, the posture sensor 38, the receiving unit 39, the display unit 9, and the setting operation unit 19 are included in the central unit 10 or disposed in the vicinity of the central unit 10. The turning actuators 24A and 24B and the PTT mechanisms 23A and 23B are provided for the respective outboard motors 15A and 15B. The engine rpm detectors 17A and 17B are provided in the respective outboard motors 15A and 15B. The trim tab actuators 22A and 22B are included in the trim tab units 20A and 20B, respectively.

The controller 30 includes a CPU 31, a ROM 32, a RAM 33, and a timer which is not illustrated. The ROM 32 stores control programs. The CPU 31 loads the control programs stored in the ROM 32 into the RAM 33 to implement various types of control processes. The RAM 33 provides a work area for the CPU 31 to execute the control programs.

Results of detection by the sensors 34 to 38 and the engine rpm detectors 17A and 17B are supplied to the controller 30. The throttle position sensor 34 detects the opening of a throttle valve, which is not illustrated. It should be noted that the opening of the throttle valve varies according to the operated amount of the throttle lever 12. The steering angle sensor 35 detects the turning angle of the steering wheel 18. The hull speed sensor 36 and the hull acceleration sensor 37 detect the speed and acceleration, respectively, of the marine vessel 11 (the hull 13) while it is sailing.

The posture sensor 38 includes, for example, a gyro sensor, a magnetic direction sensor, and so forth. Based on a signal output from the posture sensor 38, the controller 30 calculates a roll angle, a pitch angle, and a yaw angle of the hull 13. It should be noted that the controller 30 may calculate the roll angle and the pitch angle based on a signal output from the hull acceleration sensor 37. The receiving unit 39 includes a GNSS (Global Navigation Satellite Systems) receiver such as a GPS and includes a function of receiving GPS signals and various types of signals as positional information. From a speed restriction zone or land in the vicinity of the speed restriction zone, an identification signal providing notification that the area is a speed restriction zone is transmitted. The speed restriction zone refers to an area in a harbor or the like in which is required to limit the speed of a marine vessel to a predetermined speed or lower. The receiving unit 39 also includes a function of receiving the identification signal. It should be noted that the acceleration of the hull 13 may also be obtained from a GPS signal received by the receiving unit 39.

The engine rpm detectors 17A and 17B detect the number of revolutions of corresponding engines 16A and 16B per unit time (hereafter referred to as the engine rpm). It should be noted that the engine rpm varies depending on the opening of the throttle valve and the amount of fuel injected by a fuel injection device which is not illustrated. The opening of the throttle valve and the amount of fuel injected by the fuel injection device are controlled by the controller 30, and thus it can be said that the controller 30 controls the engine rpm, and by extension the rpm (or the rotation rate) of the propellers 25A and 25B (the propeller rpm). Therefore, the controller 30 also serves as a propeller rpm changing mechanism.

The display unit 9 displays various types of information. The setting operation unit 19 includes an operator that a vessel operator uses to perform operations relating to maneuvering, a PTT operating switch, a setting operator that a vessel operator uses to make various settings, and an input operator that a vessel operator uses to input various types of instructions (none of which are illustrated).

The turning actuators 24A and 24B turn the corresponding outboard motors 15A and 15B about the turning center C2 with respect to the hull 13. Turning the outboard motors 15A and 15B about the turning center C2 changes a direction in which a propulsive force acts with respect to the centerline C1 of the hull 13, which changes the course of the marine vessel 11. The mounting units 14A and 14B and the turning actuators 24A and 24B constitute a course changing mechanism of the marine vessel 11.

The PTT mechanisms 23A and 23B tilt the corresponding outboard motors 15A and 15B with respect to the clamp bracket by rotating the corresponding outboard motors 15A and 15B about the tilt shaft. The PTT mechanisms 23A and 23B are operated in response to, for example, operation of the PTT operating switch. As a result, the PTT mechanisms 23A and 23B change the inclination angles of the outboard motors 15A and 15B with respect to the hull 13.

The trim tab actuators 22A and 22B are controlled by the controller 30. For example, the trim tab actuators 22A and 22B operate in response to the controller 30 outputting control signals to them. In response to the operation of one of the trim tab actuators 22A and 22B, a corresponding tab 21 swings. It should be noted that actuators used for the PTT mechanisms 23A and 23B and the trim tab actuators 22A and 22B may be either hydraulic or electric.

It should be noted that the controller 30 may obtain results of detection by the engine rpm detectors 17A and 17B via a remote control ECU, which is not illustrated. The controller 30 may also use outboard motor ECUs (not illustrated) provided in the respective outboard motors 15A and 15B, to control the engine rpm and the propeller rpm of the outboard motors 15A and 15B.

Figure 4A:
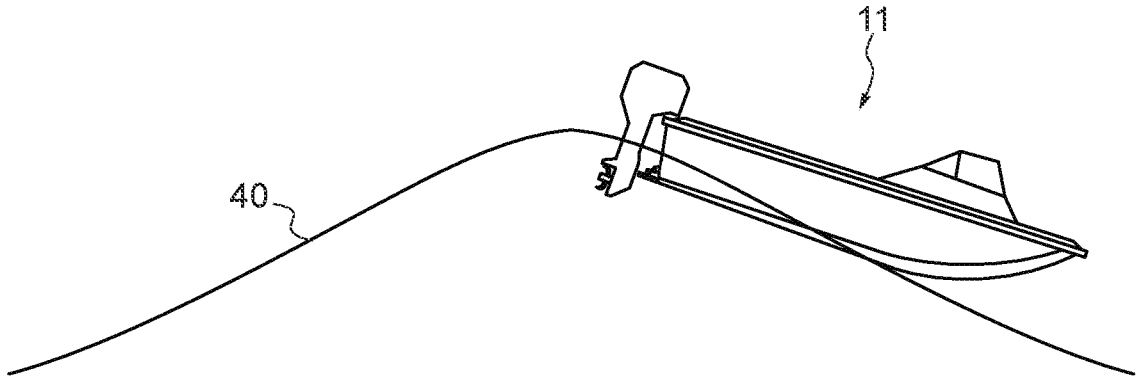
FIGS. 4A and 4B are views illustrating broaching.
Figure 4B:
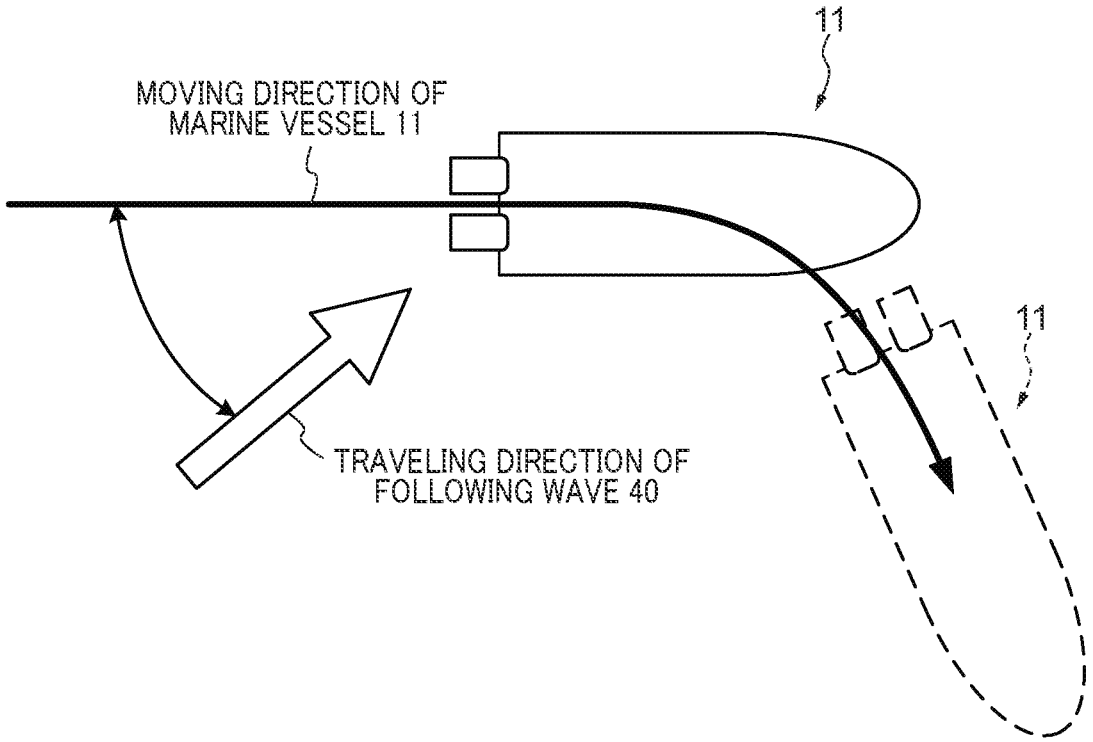

FIGS. 4A and 4B are views illustrating broaching. Broaching occurs when a marine vessel 11 is sailing on a following wave 40 traveling at the same speed as or faster than the ship speed of the marine vessel 11 (FIG. 4A). It often results in the marine vessel 11 losing rudder control when it is being accelerated forwards on the forefront slope of the following wave 40, which is then followed by surf-riding. In particular, when the marine vessel 11 encounters a following wave 40 traveling from diagonally behind and then broaching occurs, the hull 13 may make a dangerous movement by suddenly turning its head such that it become parallel to the following wave 40 (the hull 13 presents a side to the following wave and the traveling direction of the following wave 40 becomes perpendicular to the moving direction of the marine vessel 11). In FIG. 4B, the marine vessel 11 after turning its head is indicated by a broken line. At this time, there is a danger that the marine vessel 11 may be capsized because of a centrifugal force acting on the hull 13 and an impact of the following wave 40 on the hull 13.

In order for the marine vessel 11 to recover from such a sudden movement to a normal state, the rudder of the marine vessel 11 is turned in a direction opposite to a direction in which the marine vessel 11 is turning its head so that a difference between the traveling direction of the following wave 40 and the moving direction of the marine vessel 11 can be eliminated. In the present embodiment, upon detecting a sudden movement of the marine vessel 11 originating from broaching after detecting occurrence of the broaching, the controller 30 causes the course changing mechanism to control the moving direction of the marine vessel 11 so as to coincide with the traveling direction of the following wave 40. Alternatively, the controller 30, which works as the propeller rpm changing mechanism, may increase the rpm (rotation rate) of the propellers 25A and 25B by increasing the engine rpm so that the ship speed of the marine vessel 11 can increase, enabling the marine vessel 11 to escape the following wave 40 and restore rudder control. This also controls the moving direction of the marine vessel 11 so as to coincide with the traveling direction of the following wave 40 and thus enables the marine vessel 11 to recover from the sudden movement originating from broaching. Thus, in the present embodiment, increasing the rpm of the propellers 25A and 25B in addition to changing the course of the marine vessel 11 is employed as a way to cause the marine vessel 11 to recover from the sudden movement originating from broaching. It should be noted that the controller 30 also serves as a detector of the marine vessel 11, which not only detects an occurrence of broaching and a sudden movement of the marine vessel 11 originating from broaching but also judges whether or not the marine vessel 11 has recovered from a sudden movement originating from broaching and whether or not preconditions of occurrence of broaching are satisfied as will be described later.

Figure 5:
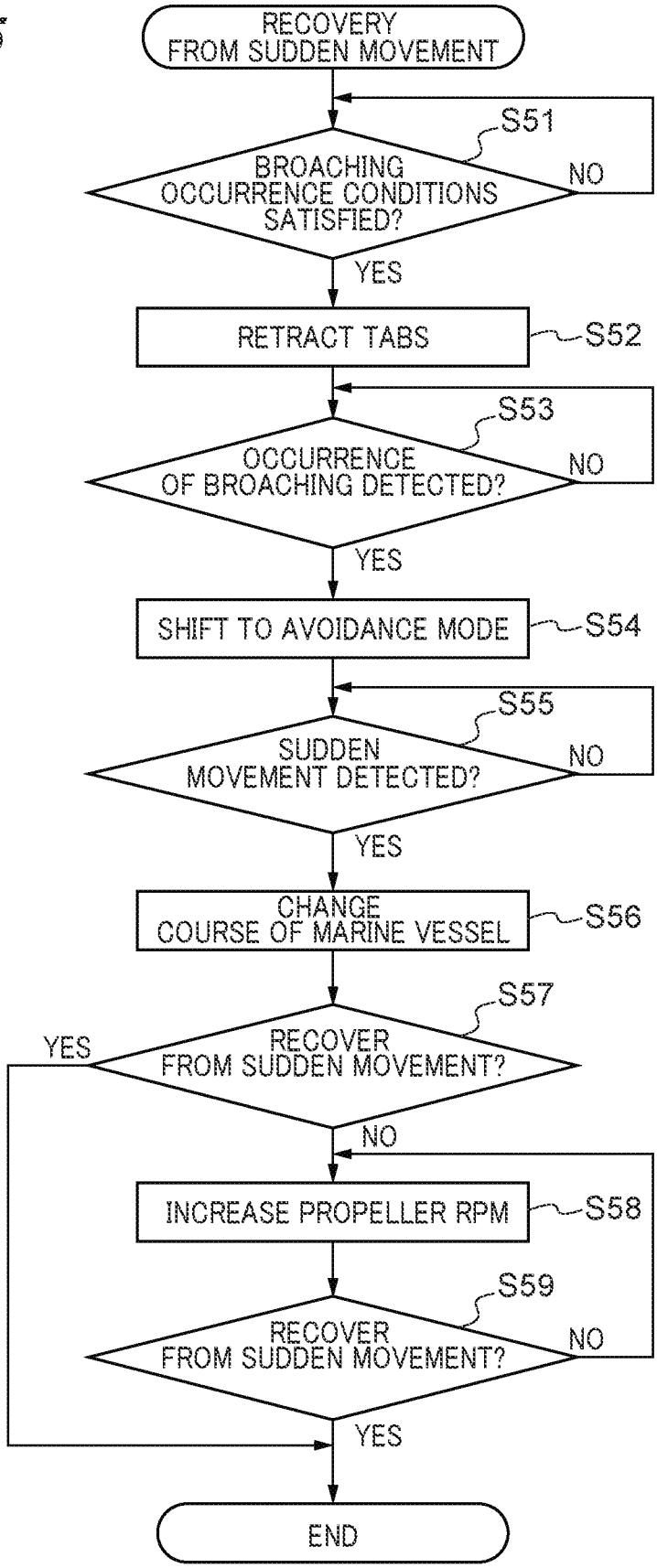
FIG. 5 is a flowchart of a process of recovering from a sudden movement of the marine vessel, which is carried out by the course control system for the marine vessel.

FIG. 5 is a flowchart of a process of recovering from a sudden movement of the marine vessel, which is carried out by the course control system for the marine vessel according to the present embodiment. This process in FIG. 5 is implemented by the controller 30 loading a control program stored in the ROM 32 into the RAM 33 and executing the same.

Referring to FIG. 5, first, the controller 30 judges whether or not the marine vessel 11 satisfies preconditions of occurrence of broaching (broaching occurrence conditions) (step S51).

Figure 6:
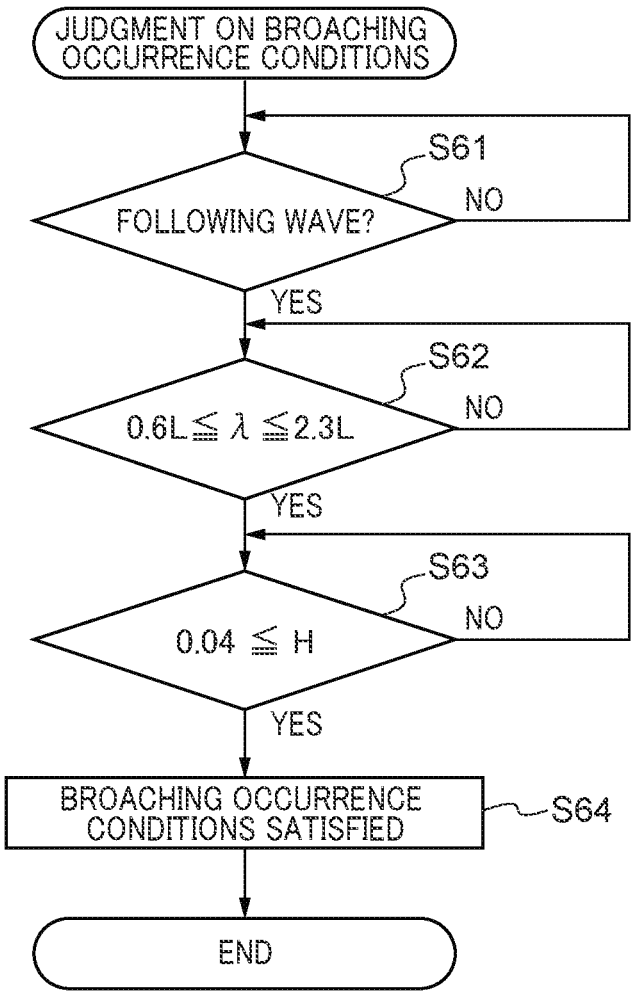
FIG. 6 is a flowchart of a process of judging whether or not the marine vessel satisfies broaching occurrence conditions.

FIG. 6 is a flowchart of a process of judging whether or not the marine vessel 11 satisfies the broaching occurrence conditions, which is carried out in the step S51 in FIG. 5. Referring to FIG. 6, first, the controller 30 judges whether or not a wave that the marine vessel 11 is now encountering is a following wave (step S61). Specifically, the controller 30 calculates the pitch angle and the roll angle of the hull 13 based on signals from the hull acceleration sensor 37 and the posture sensor 38 and judges whether or not the wave that the marine vessel 11 is encountering is a following wave.

Figure 7A:
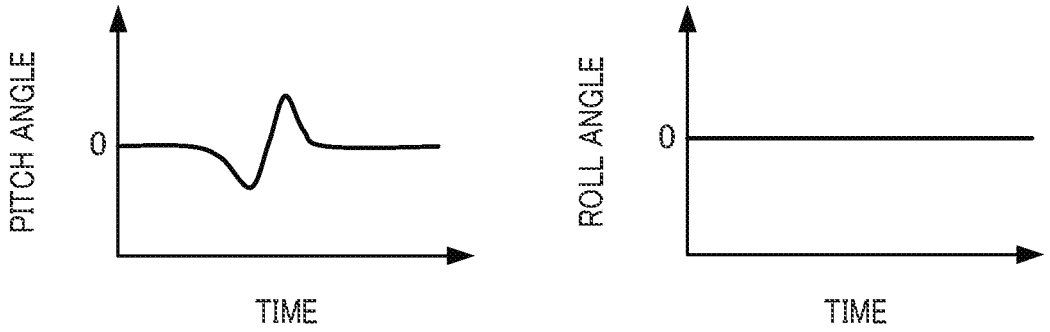
FIGS. 7A, 7B, and 7C are views illustrating how a pitch angle and a roll angle of the hull of the marine vessel vary over time as the marine vessel encounters a wave.

For example, FIG. 7A illustrates how the pitch angle and the roll angle vary over time in a case where the marine vessel 11 encounters a following wave from right behind. In this case, first, the marine vessel 11 moves on the downward slope of the following wave, and hence its bow lowers, resulting in the pitch angle being decreased. After that, when the following wave overtakes the marine vessel 11, the marine vessel 11 moves on the upward slope of the following wave, and hence its bow rises, resulting in the pitch angle being increased. It should be noted that in the case where the marine vessel 11 encounters a following wave from right behind, sides of the marine vessel 11 do not take the wave, and therefore, the marine vessel 11 does not roll, keeping the roll angle constant.

Figure 7B:
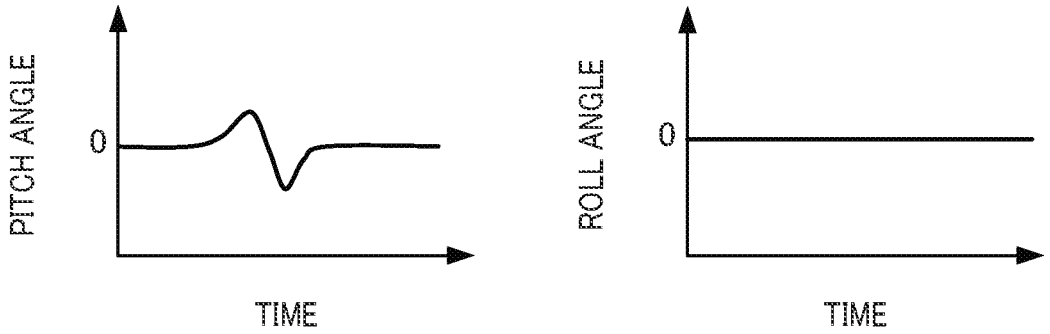

FIG. 7B illustrates how the pitch angle and the roll angle vary over time in a case where the marine vessel 11 encounters a head wave head-on. In this case, first, the marine vessel 11 climbs up the upward slope of the head wave, and hence its bow rises, resulting in the pitch angle being increased. After that, when the head wave passes the marine vessel 11, the marine vessel 11 descends the downward slope of the head wave, and hence its bow lowers, resulting in the pitch angle being decreased. It should be noted that in the case where the marine vessel 11 encounters a head wave head-on, sides of the marine vessel 11 do not take the wave as stated above, and therefore, the marine vessel 11 does not roll, keeping the roll angle constant.

Namely, the pitch angle varies over time in different ways in the case where the marine vessel 11 encounters a following wave from right behind and the case where the marine vessel 11 encounters a head wave head-on. For this reason, based on variations in the pitch angle over time, the controller 30 is capable of judging whether or not a wave that the marine vessel 11 is now encountering is a following wave.

Figure 7C:
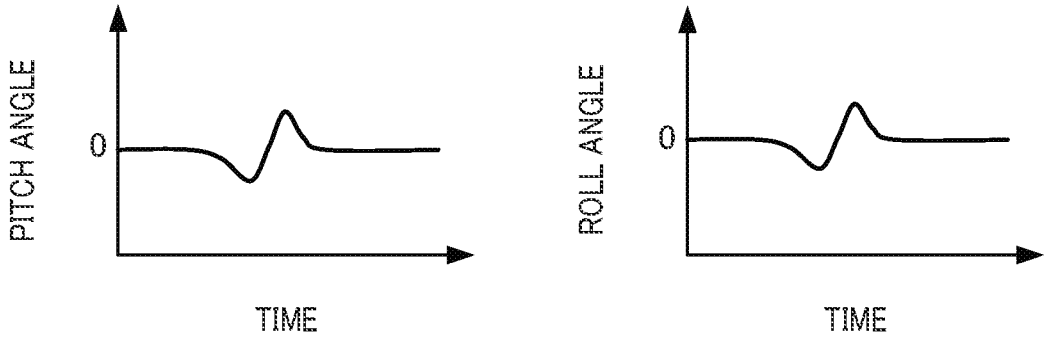

FIG. 7C illustrates how the pitch angle and the roll angle vary over time in a case where the marine vessel 11 encounters a following wave from behind the starboard. In this case, the pitch angle varies in the same way as in the case where the marine vessel 11 encounters a following wave from right behind. On the other hand, the downward slope of the wave lifts the rear part of the starboard of the hull 13, causing the hull 13 to roll leftward (in the figure, leftward rolling is indicated by negative angles, and rightward rolling is indicated by positive angles). When the following wave passes the marine vessel 11, the upward slope of the wave lifts the front part of the port, causing the hull 13 to roll rightward. Thus, by checking variations in the roll angle over time as well as variations in the pitch angle over time, the controller 30 is capable of judging whether the marine vessel 11 is encountering a wave from the starboard or the port.

When the angle at which the marine vessel 11 encounters a wave (the angle which the moving direction of the marine vessel 11 forms with the traveling direction of the wave) changes, the absolute value of a change in the roll angle changes, too. For example, the absolute value of a change in the roll angle is the greatest when the marine vessel 11 encounters a wave that perpendicularly crosses the starboard of the hull 13. Thus, the angle at which the marine vessel 11 encounters a wave can be estimated by checking a change in the absolute value of the roll angle. It should be noted that the angle at which the marine vessel 11 encounters a wave may be visually observed by the vessel operator.

In the present embodiment, the angle at which the marine vessel 11 encounters a wave is referred to as an encounter angle. The encounter angle is an angle at which a wave travels toward the marine vessel 11 as the marine vessel 11 is seen from above. When a wave travels toward the marine vessel 11 from the front, the encounter angle is 0°. The encounter angle increases in a clockwise direction. For example, the encounter angle of a following wave that the marine vessel encounters from right behind (a wave traveling in the same direction as the moving direction of the marine vessel 11) is 180°, the encounter angle of a following wave that travels toward the marine vessel 11 from 30° behind the starboard of the marine vessel 11 is 150°, and the encounter angle of a following wave that travels toward the marine vessel 11 from 45° behind the port of the marine vessel 11 is 225°.

Referring again to FIG. 6, when the controller 30 judges in the step S61 that the wave the marine vessel 11 is encountering is not a following wave, the process returns to the step S61, and when the controller 30 judges in the step S61 that the wave the marine vessel 11 is encountering is a following wave, the process proceeds to step S62.

In the guidance (Revised Guidance to the Master for Avoiding Dangerous Situations in Adverse Weather and Sea Conditions, issued on Jan. 11, 2007) issued by the International Maritime Organization (hereafter referred to as "the IMO guidance"), it is said that the stability of a marine vessel decreases when the center of the marine vessel is riding on a crest of a following wave in a case where a wavelength $\lambda$ of the wave is 0.6 to 2.3 times as long as a length L between perpendiculars of the marine vessel 11. It is also said that the marine vessel 11 is likely to surf-ride on a following wave in a case where a condition that a wave height H of the wave is equal to or greater than 0.04 times as long as the length L between the perpendiculars is satisfied in addition to the above condition.

Accordingly, in the step S62, the controller 30 judges whether or not the wavelength $\lambda$ of the wave is 0.6 to 2.3 times as long as the length L between perpendiculars of the marine vessel 11. When the wavelength $\lambda$ of the wave is less than 0.6 times as long as the length L between the perpendiculars or greater than 2.3 times as long as the length L between the perpendiculars, the process returns to the step S62, and when the wavelength $\lambda$ of the wave is 0.6 to 2.3 times as long as the length L between perpendiculars of the marine vessel 11, the process proceeds to step S63.

In the step S63, the controller 30 further judges whether or not the wavelength $\lambda$ of the following wave is equal to or greater than 0.04 times as long as the length L between the perpendiculars. When the wavelength $\lambda$ of the following wave is less than 0.04 times as long as the length L between the perpendiculars, the process returns to the step S63, and when the wavelength $\lambda$ of the wave is equal to or greater than 0.04 times as long as the length L between the perpendiculars, the process proceeds to step S64, in which the controller 30 in turn judges that the conditions of the occurrence of broaching (the broaching occurrence conditions) in which the marine vessel 11 may surf-ride on the following wave, are satisfied. The controller 30 then ends the process in FIG. 6.

The wavelength λ of the wave in the step S62 is estimated based on a conversion graph illustrated in FIG. 1 of the IMO guidance. Specifically, an actual wave period of the wave is obtained from the conversion graph based on the ship speed of the marine vessel 11, encounter angle, and period (perceived wave period) of the wave observed in the marine vessel 11, and then the wavelength λ is calculated from the actual wave period. It should be noted that the perceived wave period is calculated by obtaining a period of up-and-down motions from a change in the acceleration of up-and-down motions of the hull 13 measured by the hull acceleration sensor 37.

Figure 8:
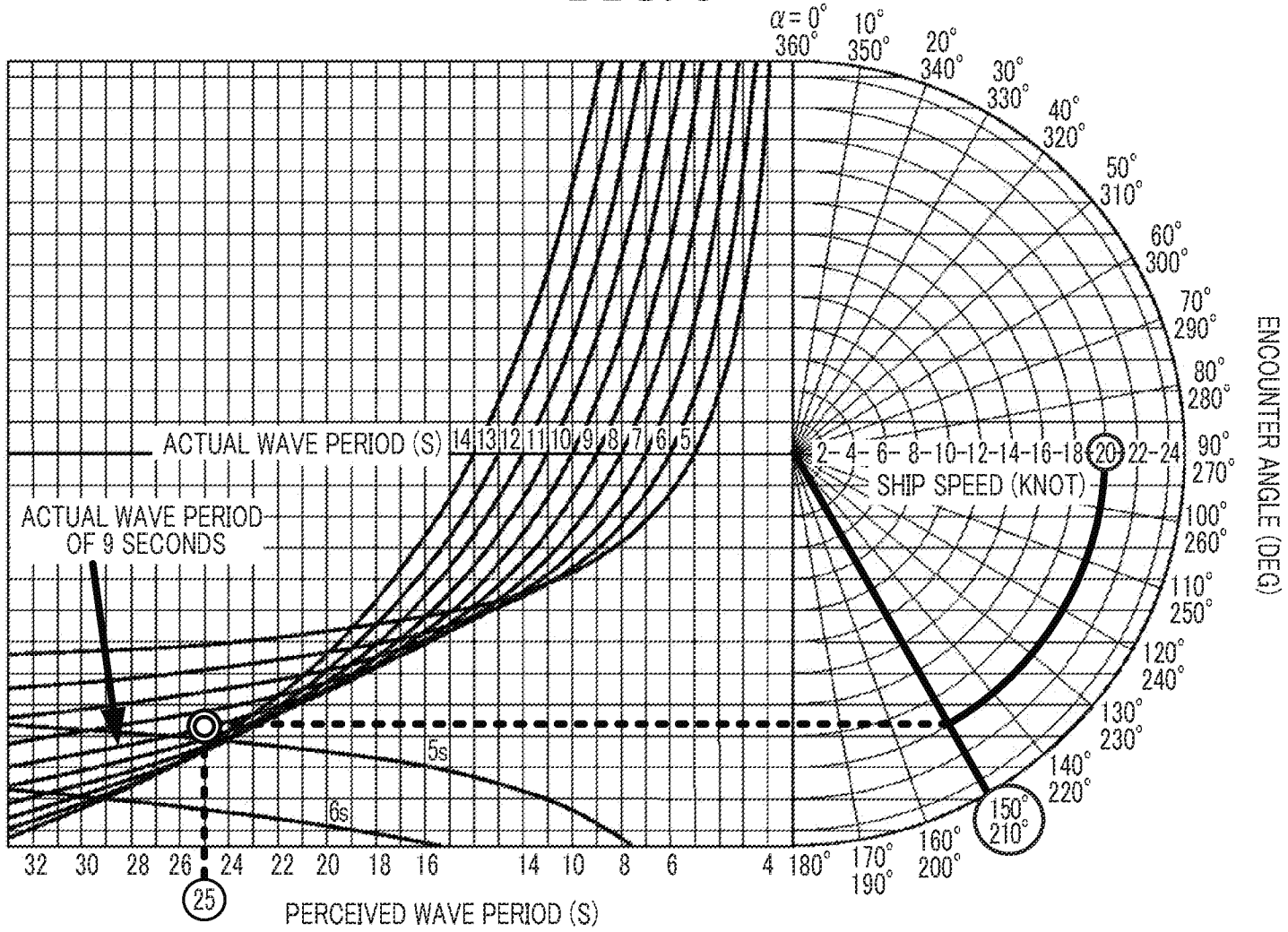
FIG. 8 is a view illustrating a concrete example of how an actual wave period is obtained from a ship speed of the marine vessel, encounter angle, and perceived wave period, using an actual wave period conversion graph given in the IMO guidance.

FIG. 8 is a view illustrating a concrete example of how the actual wave period of a wave is obtained from the ship speed of the marine vessel 11, encounter angle, and perceived wave period using the actual wave period conversion graph in the IMO guidance.

Referring to FIG. 8, a description will be given of how the actual wave period of a concerned wave is obtained in a case where, for example, the ship speed is 20 knot, the encounter angle is 150°, and the perceived wave period is 25 seconds. First, a point at which a line indicating the ship speed of 20 knot and a line indicating the encounter angle of 150° (both are indicated by thick solid lines) cross each other is found in a semicircular graph on the right-hand side of the conversion graph in FIG. 8. Next, a point (indicated by a double circle) at which an extension (indicated by a broken line) of the above point crosses a line indicating the perceived wave period of 25 seconds is found in a graph on the left-hand side of the conversion graph. Then, a period of nine seconds which is the actual wave period passing through an area closest to this point is read, and this period of nine seconds is considered as the actual wave period of the wave.

After that, the wavelength λ is obtained from the mathematical expression (1). Namely, the wavelength of a following wave is obtained based on the ship speed, acceleration, and moving direction of the marine vessel 11 and the traveling direction of the following wave.

$$\lambda(m)=1.56\times(\text{actual wave period (seconds)})\hat{}2 \quad (1)$$

The wave height H of the wave is obtained by calculating the amount of change in a vertical position of the hull 13 by integrating a vertical component of the acceleration of the hull 13, which is measured by the hull acceleration sensor 37, two times.

It should be noted that the sequence of the steps in the process for judging whether or not the marine vessel 11 satisfies the broaching occurrence conditions is not limited to the one shown in FIG. 6 but may be changed as appropriate.

Referring again to FIG. 5, when the controller 30 judges in the step S51 that the marine vessel 11 does not satisfy the broaching occurrence conditions, the process returns to the step S51, and when the controller 30 judges in the step S51 that the marine vessel 11 satisfies the broaching occurrence conditions, the process proceeds step S52, in which the controller 30 in turn causes the trim tab actuators 22A and 22B to actuate and swing the corresponding tabs 21 to the retracted position inside the hull 13.

Then, the controller 30 judges whether or not the occurrence of broaching has been detected (step S53).

According to the IMO guidance, broaching may occur in cases where the encounter angle of a following wave is equal to or greater than 135° and equal to or smaller than 225°. As the ship speed of the marine vessel 11 increases, the time period over which the marine vessel 11 rides on the downward slope of the following wave increases, causing broaching to occur. The ship speed at which broaching occurs is referred to as a broaching occurrence critical speed. The broaching occurrence critical speed is specified with respect to each encounter angle, and when the ship speed of the marine vessel 11 becomes higher than the broaching occurrence critical speed, it is considered that broaching has occurred. According to the IMO guidance, the broaching occurrence critical speed with respect to each encounter angle is expressed by the mathematical expression (2).

$$\text{Broaching occurrence critical speed (knot)}=1.8\times\sqrt{L(m)}/\cos(180°-\alpha) \quad (2)$$

It should be noted that a ship speed at which there is a very high possibility of broaching even though broaching does not occur is referred to as a broaching occurrence marginal speed, and the broaching occurrence marginal speed with respect to each encounter angle is expressed by the mathematical expression (3).

$$\text{Broaching occurrence marginal speed (knot)}=1.4\times\sqrt{L(m)}/\cos(180°-\alpha) \quad (3)$$

In the above expressions (2) and (3), L is the length (m) between the perpendiculars of the marine vessel 11 (the hull 13), and α is the encounter angle (deg), which is specified as $135° \leq \alpha \leq 225°$.

Figure 9:
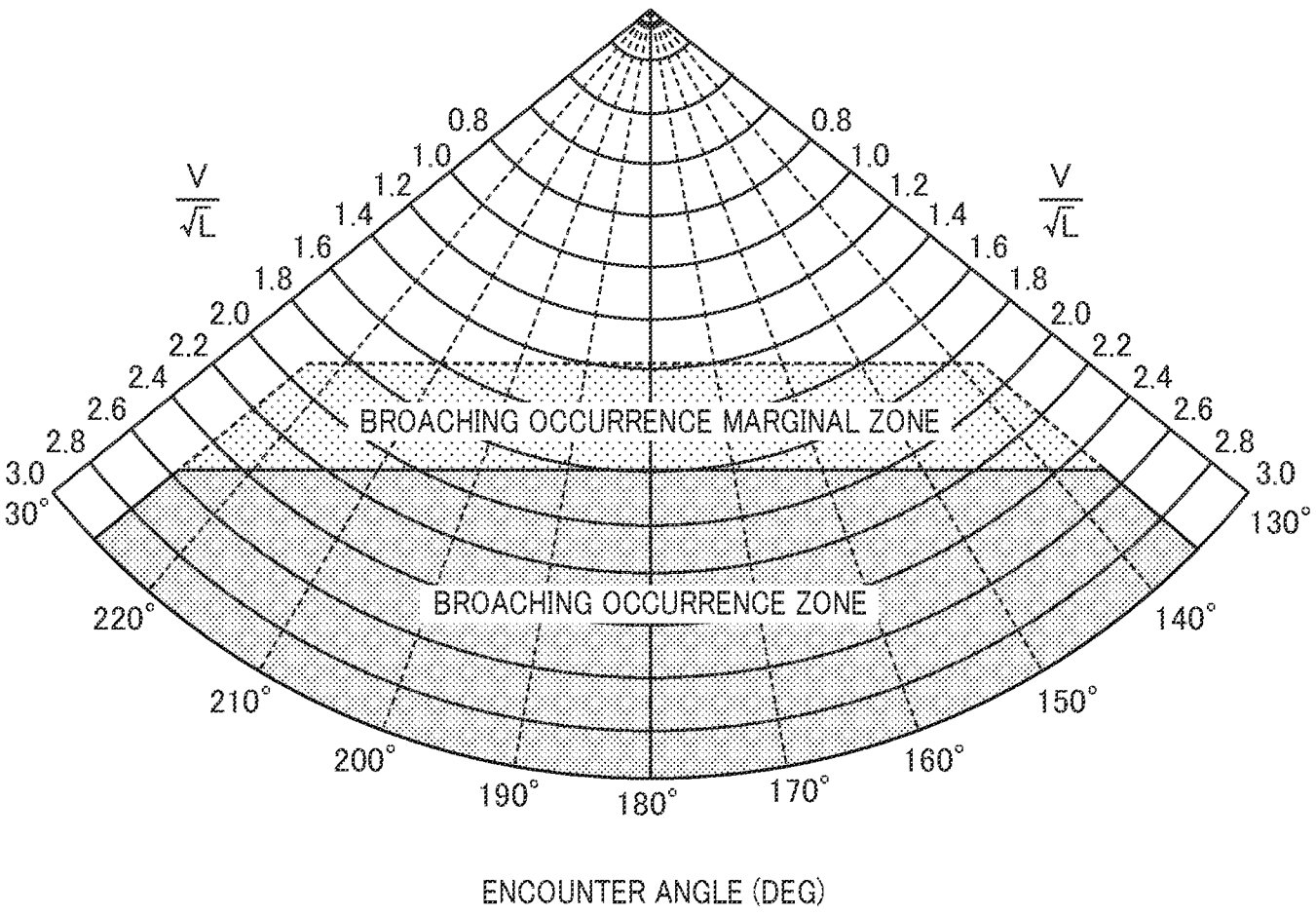
FIG. 9 is a graph illustrating a broaching occurrence marginal zone and a broaching occurrence zone with respect to encounter angles.

FIG. 9 is a graph illustrating a broaching occurrence marginal zone and a broaching occurrence zone with respect to encounter angles.

The broaching occurrence marginal zone enclosed by a broken line in FIG. 9 is a zone specified by a value obtained by dividing the broaching occurrence marginal speed calculated from the above expression (3) by the square root of the length L between the perpendiculars of the marine vessel 11. In this broaching occurrence marginal zone, there is a very high possibility that broaching may occur. The broaching occurrence zone enclosed by a solid line in FIG. 9 is a zone specified by a value obtained by dividing the broaching occurrence critical speed calculated from the above expression (2) by the square root of the length L between the perpendiculars of the marine vessel 11. In this broaching occurrence zone, it is considered that broaching has occurred.

Thus, in the step S53, when the ship speed of the marine vessel 11 is not higher than the broaching occurrence critical speed, the controller 30 considers that the occurrence of broaching has not been detected, and the process returns to the step S53. When the ship speed of the marine vessel 11 is higher than the broaching occurrence critical speed, the controller 30 considers that the occurrence of broaching has been detected, and the process proceeds to the step S54.

In the step S54, the marine vessel 11 shifts into an avoidance mode. The avoidance mode is a mode in which the marine vessel 11 prepares for a motion of recovery from a sudden movement originating from broaching, which will be described later. In the avoidance mode, the controller 30 monitors the operated amount of the steering wheel 18 and the yaw rate of the hull 13.

Then, the controller 30 judges whether or not a sudden movement originating from broaching which may capsize the marine vessel 11 has been detected (step S55). Specifically, in a case where an actual yaw rate at the time when marine vessel 11 turned its head is equal to or greater than a yaw rate estimated from the amount of operation on the steering wheel 18 by the vessel operator, and the marine vessel 11 changed its course in a direction in which it would encounter a following wave, the controller 30 detects a sudden movement originating from broaching. Examples of the case where the marine vessel 11 changes its course in a direction in which it will encounter a following wave include a case where the marine vessel 11 changes its course to starboard when it is encountering a following wave from behind the starboard (the encounter angle is from 135° to) 180°, and a case where the marine vessel 11 changes its course to port when it is encountering a following wave from behind the port (the encounter angle is from 180° to 225°). When the actual yaw rate at the time when marine vessel 11 turned its head is smaller than the yaw rate estimated from the amount of operation on the steering wheel 18 by the vessel operator, or when the marine vessel 11 has changed its course in a direction opposite to a direction in which the marine vessel 11 would encounter a following wave, the controller 30 does not detect a sudden movement originating from broaching.

Here, the case where the actual yaw rate at the time when the marine vessel 11 turned its head is equal to or greater than the yaw rate estimated from the amount of operation on the steering wheel 18 by the vessel operator corresponds to a case where the course of the marine vessel 11 is different from a course estimated from the amount of operation on the steering wheel 18. It should be noted that in the present embodiment, a map showing the amounts of operation on the steering wheel 18 and the yaw rates estimated from the amounts of operation is prepared in advance and stored in, for example, the ROM 32. In the step S55, the controller 30 refers to this map.

In the step S55, when the controller 30 judges that a sudden movement originating from broaching has not been detected, the process returns to the step S55, and when the controller 30 judges that a sudden movement originating from broaching has been detected, the controller 30 changes, by using the course changing mechanism, the course of the marine vessel 11 so as to reduce a difference between the moving direction of the marine vessel 11 and the traveling direction of the following wave (step S56).

Then, the controller 30 judges whether or not the marine vessel 11 has recovered from the sudden movement originating from broaching (step S57). Specifically, the controller 30 judges whether or not the course of the marine vessel 11 has returned to a course which the marine vessel was taking before the occurrence of broaching. For example, when a difference between the moving direction of the marine vessel 11 after it changed its course in the step S56 and the moving direction of the marine vessel 11 before the occurrence of broaching is equal to or smaller than a predetermined value, the controller 30 judges that the marine vessel 11 has recovered from the sudden movement originating from broaching.

In the step S57, when the controller 30 judges that the marine vessel 11 has recovered from the sudden movement originating from broaching, the controller 30 ends the present process by causing the course changing mechanism to stop changing the course of the marine vessel 11, and when the controller 30 judges that the marine vessel 11 has not yet recovered from the sudden movement originating from broaching, the controller 30 increases the propeller rpm to a predetermined value (step S58). The case where the controller 30 judges in the step S57 that the marine vessel 11 has not recovered from the sudden movement originating from broaching corresponds to a case where the sudden movement of the marine vessel 11 is serious, the marine vessel 11 slides crosswise on the wave, and its crosswise movement component is greater than a predetermined value.

When the controller 30 increases the propeller rpm of to the predetermined value in the step S58, the marine vessel 11 accelerates and goes out of the broaching occurrence zone, resulting in rudder control being restored. As a result, the course of the marine vessel 11 becomes closer to a course which the marine vessel 11 was taking before the occurrence of the sudden movement originating from broaching.

Then, the controller 30 judges again whether or not the marine vessel 11 has recovered from the sudden movement originating from broaching (step S59). The way to judge in the step S59 whether or not the marine vessel 11 has recovered from the sudden movement originating from broaching is the same as the way to judge in the step S57 whether or not the marine vessel 11 has recovered from the sudden movement originating from broaching.

In the step S59, when the controller 30 judges that the marine vessel 11 has not recovered from the sudden movement originating from broaching, the process returns to the step S58, and when the controller 30 judges that the marine vessel 11 has recovered from the sudden movement originating from broaching, the controller 30 ends the present process.

According to the process in FIG. 5, when detecting the occurrence of broaching, and then detecting a sudden movement of the marine vessel 11 originating from the broaching, the controller 30 causes the course changing mechanism to change the course of the marine vessel 11 so that a difference between the moving direction of the marine vessel 11 and the traveling direction of a following wave can be reduced. It allows the marine vessel 11 to easily recover from the sudden movement originating from broaching without relying on the vessel operator.

Moreover, in the present embodiment, in order for the marine vessel 11 to recover from a sudden movement originating from broaching, the controller 30 causes the course changing mechanism to control the course of the marine vessel 11 first, and then the propeller rpm changing mechanism (the controller 30) increases the propeller rpm as appropriate. This prevents the marine vessel 11 from accelerating unexpectedly and making the vessel operator surprised.

Furthermore, in the present embodiment, even when the occurrence of broaching has been detected, the course of the marine vessel 11 is not changed until a sudden movement of the marine vessel 11 originating from broaching is detected. This keeps irregularities in the course of the marine vessel 11 to a minimum.

Additionally, in the present embodiment, when the controller 30 judges that the marine vessel 11 satisfies the broaching occurrence conditions, the tabs 21 of the tab units 20A and 20B are swung to the retracted position, so as to prevent behavior irregularities of the marine vessel 11, which occurs because of the tabs 21 encountering a following wave, from increasing.

While the embodiment of the present invention has been described above, it is to be understood that variations and modifications will be apparent to those skilled in the art without departing from the scope and spirit of the present invention. The scope of the present invention, therefore, is to be determined solely by the following claims.

For example, although in the present embodiment, for the marine vessel 11 to recover from a sudden movement originating from broaching, the controller 30 changes the course of the marine vessel 11 using the course changing mechanism first, and then the propeller rpm changing mechanism (the controller 30) increases the propeller rpm, the method of recovering the marine vessel 11 from a sudden movement originating from broaching is not limited to this. For example, when detecting a sudden movement originating from broaching, first, the controller 30 may slightly change the course of the marine vessel 11 using the course changing mechanism, and then the propeller rpm changing mechanism (the controller 30) may slightly increase the propeller rpm. After that, if the marine vessel 11 has not recovered from the sudden movement originating from broaching, the controller 30 may change the course of the marine vessel 11 using the course changing mechanism to a large extent, and then the propeller rpm changing mechanism (the controller 30) may increase the propeller rpm to a large extent.

Moreover, the controller 30 may decrease the propeller rpm instead of increasing the propeller rpm. For example, the controller 30 may decrease the ship speed by decreasing the propeller rpm so that the marine vessel 11 can go out of the state in the broaching occurrence marginal zone in FIG. 9.

It should be noted that as the posture control tabs, interceptor tabs may be used in place of the tabs 21. The interceptor tabs are attached to both sides of the stern of the hull 13 and shift their position in substantially the vertical direction. Specifically, each of the interceptor tabs changes its position in the water from a position at which it projects from a bottom surface (the vessel bottom) of the hull 13 to a position which is above the bottom surface of the hull 13. When the controller 30 judges in the step S51 that the marine vessel 11 satisfies the broaching occurrence conditions, the interceptor tabs shift to the retracted position.

Although in the embodiment, the marine vessel 11 is equipped with the outboard motors 15A and 15B, the marine vessel 11 may be equipped with other types of marine propulsion devices such as inboard/outboard motors (stern drive, inboard motor/outboard drive) and inboard motors. The marine vessel 11 may be moved by propulsive force provided by, for example, a water jet, rather than propulsive force provided by a propeller. In this case, the controller 30 increases the rpm of an impeller of the water jet to a predetermined value.

What is claimed is:

1. A course control system for a marine vessel having a propeller that provides propulsive force to the marine vessel, the course control system comprising:

a course changing mechanism that changes a course of the marine vessel; and a controller configured or programmed to:

detect a sudden movement of the marine vessel originating from broaching caused by a following wave of the marine vessel in a case where an actual yaw rate at a time when the marine vessel turns its head is greater than a yaw rate estimated from an amount of operation by a vessel operator, and the marine vessel changed its course in a direction in which the marine vessel is to encounter the following wave, and upon detecting the sudden movement of the marine vessel originating from the broaching, control a rotation rate of the propeller and/or cause the course changing mechanism to change the course of the marine vessel.

2. The course control system according to claim 1, wherein, upon detecting the sudden movement of the marine vessel originating from the broaching after detecting the broaching, the controller causes the course changing mechanism to change the course of the marine vessel.

3. The course control system according to claim 2, wherein the controller causes the course changing mechanism to change the course of the marine vessel, to thereby reduce a difference between a moving direction of the marine vessel and a traveling direction of the following wave.

4. The course control system according to claim 1, wherein when a crosswise movement component of the marine vessel becomes greater than a predetermined value after the controller detects the sudden movement of the marine vessel originating from the broaching, the controller increases the rotation rate of the propeller.

5. The course control system according to claim 1, wherein the controller judges that the marine vessel has recovered from the sudden movement originating from the broaching, responsive to the course of the marine vessel returning to a course the marine vessel was taking before occurrence of the sudden movement after the controller causes the course changing mechanism to change the course of the marine vessel upon detecting the sudden movement, and upon judging that the marine vessel has recovered from the sudden movement, causes the course changing mechanism to stop changing the course of the marine vessel.

6. The course control system according to claim 1, wherein the marine vessel further includes at least one posture control tab for controlling a posture of the marine vessel, and at least one actuator that respectively actuates the at least one posture control tab, and when preconditions of occurrence of the broaching are satisfied, the controller causes the at least one actuator to retract the at least one posture control tab into a hull of the marine vessel.

7. The course control system according to claim 1, wherein the controller judges that preconditions of occurrence of the broaching are satisfied in a case where a wavelength of the following wave is 0.6 to 2.3 times as long as a length between perpendiculars of the marine vessel, and a condition that a wave height of the following wave is equal to or greater than 0.04 times as long as the length between the perpendiculars is satisfied.

8. The course control system according to claim 7, wherein the wavelength of the following wave is obtained based on a ship speed, an acceleration, and a moving direction of the marine vessel and the traveling direction of the following wave.

9. A marine vessel comprising:

a propeller that provides propulsive force to the marine vessel; and a course control system including:

a course changing mechanism that changes a course of the marine vessel; and a controller configured or programmed to:

detect a sudden movement of the marine vessel originating from broaching caused by a following wave of the marine vessel in a case where an actual yaw rate at a time when the marine vessel turns its head is greater than a yaw rate estimated from an amount of operation by a vessel operator, and the marine vessel changed its course in a direction in which the marine vessel is to encounter the following wave, and upon detecting the sudden movement of the marine vessel originating from the broaching, control a rotation rate of the propeller and/or cause the course changing mechanism to change the course of the marine vessel.

10. The marine vessel according to claim 9, wherein, upon detecting the sudden movement of the marine vessel originating from the broaching after detecting the broaching, the controller causes the course changing mechanism to change the course of the marine vessel.

11. The marine vessel according to claim 10, wherein the controller causes the course changing mechanism to change the course of the marine vessel, to thereby reduce a difference between a moving direction of the marine vessel and a traveling direction of the following wave.

12. The marine vessel according to claim 9, wherein when a crosswise movement component of the marine vessel becomes greater than a predetermined value after the controller detects the sudden movement of the marine vessel originating from the broaching, the controller increases the rotation rate of the propeller.

13. The marine vessel according to claim 9, wherein the controller judges that the marine vessel has recovered from the sudden movement originating from the broaching, responsive to the course of the marine vessel returning to a course the marine vessel was taking before occurrence of the sudden movement after the controller causes the course changing mechanism to change the course of the marine vessel upon detecting the sudden movement, and upon judging that the marine vessel has recovered from the sudden movement, causes the course changing mechanism to stop changing the course of the marine vessel.

14. The marine vessel according to claim 9, further comprising at least one posture control tab for controlling a posture of the marine vessel; and at least one actuator that respectively actuates the at least one respective posture control tab, wherein, when preconditions of occurrence of the broaching are satisfied, the controller causes the at least one actuator to retract the at least one posture control tab into a hull of the marine vessel.

15. The marine vessel according to claim 9, wherein the controller judges that preconditions of occurrence of the broaching are satisfied in a case where a wavelength of the following wave is 0.6 to 2.3 times as long as a length between perpendiculars of the marine vessel, and a condition that a wave height of the following wave is equal to or greater than 0.04 times as long as the length between the perpendiculars is satisfied.

16. The marine vessel according to claim 15, wherein the wavelength of the following wave is obtained based on a ship speed, an acceleration, and a moving direction of the marine vessel and the traveling direction of the following wave.

17. A course control system for a marine vessel, comprising:

a controller configured or programmed to:

judges that preconditions of occurrence of a broaching are satisfied in a case where a wavelength of a following wave is 0.6 to 2.3 times as long as a length between perpendiculars of the marine vessel, and a condition that a wave height of the following wave is equal to or greater than 0.04 times as long as the length between the perpendiculars is satisfied.

18. The marine vessel of claim 9, wherein the controller detects occurrence of broaching when a ship speed of the marine vessel is higher than a broaching occurrence critical speed.

19. The course control system of claim 1, wherein the controller detects occurrence of broaching when a ship speed of the marine vessel is higher than a broaching occurrence critical speed.

* * * * *